US007370639B2

(12) United States Patent
Jung et al.

(10) Patent No.: US 7,370,639 B2
(45) Date of Patent: May 13, 2008

(54) SUPERCHARGED DIESEL ENGINE WITH A COMMON-RAIL INJECTION SYSTEM

(75) Inventors: Ulrich Jung, Eckental (DE); Udo Fakler, Winkelhaid (DE)

(73) Assignee: MAN Nutzfahrzeuge AG (DE)

( * ) Notice: Subject to any disclaimer, the term of this patent is extended or adjusted under 35 U.S.C. 154(b) by 0 days.

(21) Appl. No.: 11/293,531

(22) Filed: Dec. 2, 2005

(65) Prior Publication Data

US 2006/0118088 A1 Jun. 8, 2006

(30) Foreign Application Priority Data

Dec. 3, 2004 (DE) ..... 10 2004 058 350

(51) Int. Cl.
*F02M 55/02* (2006.01)

(52) U.S. Cl. ..... 123/468; 123/198 D; 123/456

(58) Field of Classification Search ..... 123/468, 123/469, 470, 198 D, 456, 184.21, 184.34, 123/184.42, 184.47
See application file for complete search history.

(56) References Cited

U.S. PATENT DOCUMENTS

| | | | | |
|---|---|---|---|---|
| 3,783,842 | A * | 1/1974 | Kuhn et al. | 123/470 |
| 4,702,202 | A | 10/1987 | Hensel et al. | |
| 5,568,798 | A * | 10/1996 | Lorraine | 123/456 |
| 5,819,708 | A * | 10/1998 | Buratti et al. | 123/468 |
| 6,076,505 | A * | 6/2000 | Guggenmos et al. | 123/456 |
| 6,237,569 | B1 * | 5/2001 | Stelzer et al. | 123/456 |
| 6,269,796 | B1 * | 8/2001 | Mitchell | 123/468 |
| 6,412,466 | B2 * | 7/2002 | Fredriksson et al. | 123/184.38 |
| 6,474,305 | B1 * | 11/2002 | Kimura | 123/456 |
| 6,666,020 | B2 * | 12/2003 | Tonetti et al. | 60/286 |
| 6,758,192 | B2 * | 7/2004 | Vanderveen et al. | 123/456 |
| 6,840,221 | B1 | 1/2005 | Roswells et al. | |
| 7,086,384 | B2 * | 8/2006 | Lee et al. | 123/468 |
| 2001/0037783 | A1 | 11/2001 | Fredriksson et al. | |

FOREIGN PATENT DOCUMENTS

| | | |
|---|---|---|
| DE | 195 33 419 | 5/1996 |
| EP | 1 375 897 | 6/2003 |

* cited by examiner

*Primary Examiner*—Carl S. Miller
(74) *Attorney, Agent, or Firm*—Robert W. Becker; Robert Becker & Associates

(57) ABSTRACT

A supercharged diesel engine having at least one charged air conduit for distributing charged air and having a first chamber for conveying the charged air. Air inlet openings of the cylinder head are connected to the first chamber in a gastight manner. The charged air conduit has at least one second chamber, which is separate from the first chamber and has a removable lid. The fuel reservoir is secured in the second chamber, which is provided with a first passage allowing the high pressure fuel line and the fuel reservoir to communicate with one another. The second chamber has at least one second passage, facing the cylinder head, allowing the fuel injection lines and fuel connections on the cylinder head to communicate with one another. With the lid in place, the second chamber encloses the fuel reservoir, the fuel injection lines and the fuel connections such that in the event of leakage at any of them, leaking fuel flows into the second chamber.

16 Claims, 3 Drawing Sheets

SUPERCHARGED DIESEL ENGINE WITH A COMMON-RAIL INJECTION SYSTEM

Figure 1:
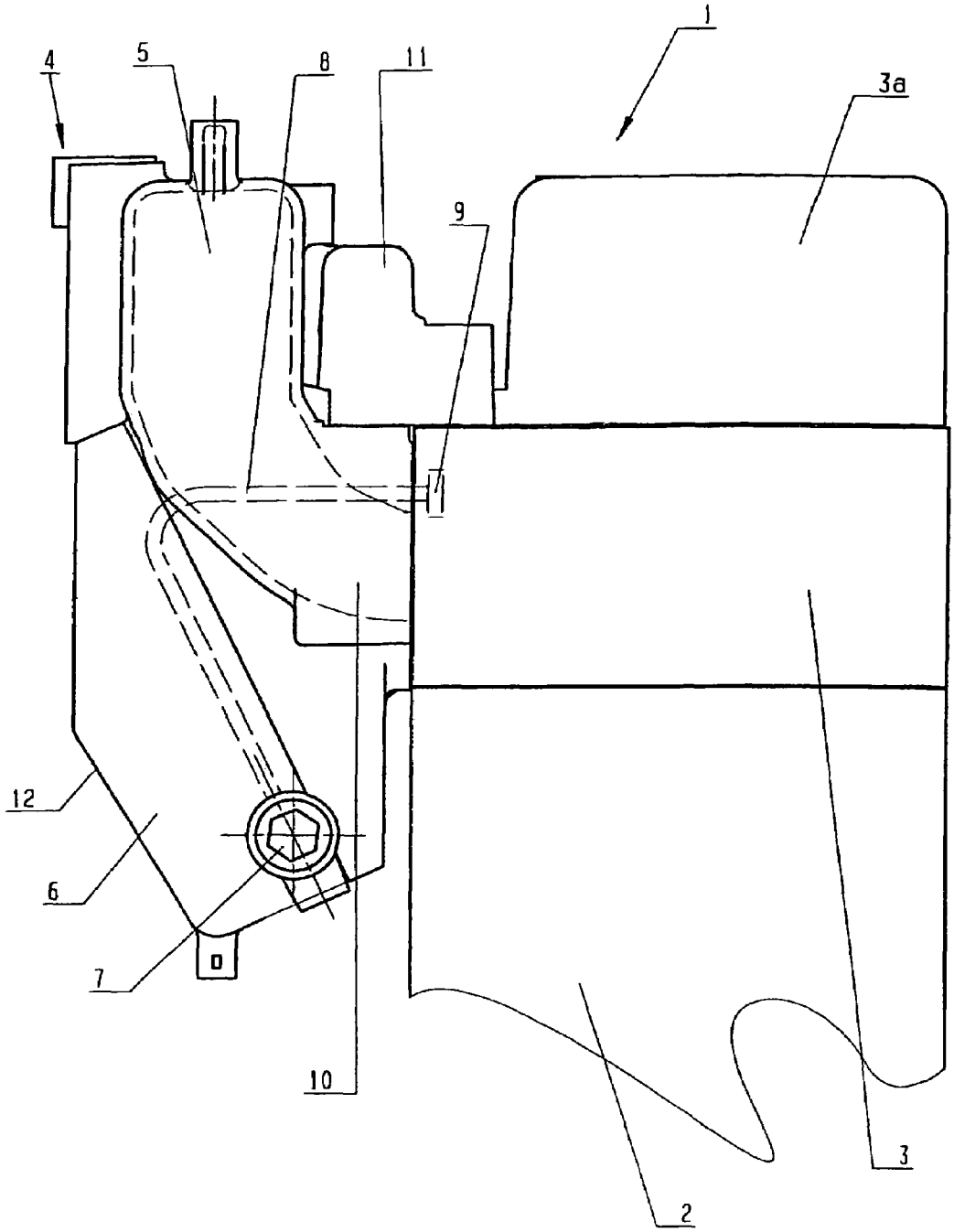

The instant application should be granted the priority date of Dec. 3, 2004, the filing date of the corresponding German patent application 10 2004 058 350.1.

BACKGROUND OF THE INVENTION

The invention concerns a supercharged diesel engine with a Common-Rail injection system.

Common-Rail injection systems are increasingly used for better fuel efficiency and optimization of pollutant emissions of diesel engines. The system pressure obtainable in such fuel injection systems is very high. It does not depend on load and engine speed and allows optimal control of the injection process. In combination with an appropriate characterization of the charging, the result is an optimization of the combustion in all load ranges.

Besides the advantages described above, Common-Rail injection systems also have a disadvantage. The very high injection pressures that range from 1500 bar to 2000 bar today and will be even higher in future systems have to be controlled. This implies an extraordinarily high material stress, especially in areas of high fuel pressure such as the high-pressure fuel reservoir and the fuel injection lines of the injection system. In case of a breakage or leakage in such a high-pressure section of the injection system, fuel might leak out in the form of fine mist. To prevent ignition and hence explosive combustion, it is essential for leaking fuel to be collected safely and without reaching the surroundings, especially if engines with such injection systems are used in safety relevant locations.

In order to meet the mentioned safety requirements, it is known from DE 197 16 513 C2 to provide a casing for the fuel reservoir and the injection lines. The casing is realized in such a manner that the high-pressure fuel reservoir is integrated into a duct or channel, which is at least partly formed of the walls of the crankcase. This arrangement allows a safe casing of the endangered areas of the injection system, yet it has significant disadvantages in practical use. The crankcase has to be constructed a certain way if the casing is to be placed in it or next to it. Changes to the structure of the crankcase are a disadvantage, because it is a complex and very expensive component that often doesn't change throughout several engine generations or is used for various different engine types with different types of injection systems. Especially if a mass-produced engine was to be retrofitted with a casing, this would mean an expensive modification of the crankcase. In addition to that, the location of the crankcase is a highly unsuitable place for the high-pressure fuel reservoir because the large masses moved in the crankcase result in an increased vibration stress for the high-pressure fuel reservoir and the connected injection lines. Since the material stress is high anyway, increased vibration stress is to be avoided. Furthermore, the arrangement described above makes it complicated to collect, drain off and detect leaking fuel for there are different places where leaking fuel might accumulate.

Another fuel injection system is known from EP 0 690 221 A1. In this system, a high-pressure fuel reservoir supplied by a high-pressure fuel pump is integrated into the wall of a cylinder head cap of a diesel engine. Injection lines lead from the high-pressure fuel reservoir to fuel injection valves located in the cylinder head. This system is supposed to be advantageous because the high-pressure fuel reservoir is protected from vibration and damage. But placing the high-pressure fuel reservoir as described above has a significant disadvantage. Every time the cylinder head cap is demounted, which has to happen frequently for maintenance purposes, all connections from the high-pressure fuel reservoir to the fuel injection lines and to the high-pressure fuel pump have to be detached. Detaching of those sensitive connections, though, has to be avoided, both because screwing on and fastening of the fuel lines causes states of stress in them and because the system has to be kept extremely clean. Besides, a complete casing of the fuel injection lines is impossible because they have to be installed after the cylinder head cap has been mounted. Therefore, mounting openings are indispensable. Another disadvantage of the arrangement described above is that it cannot be used on individual cylinder heads, which are often part of diesel engines.

Another system known from DE 75 15 413 U1 shows an internal combustion engine on which all linesnecessary for fuel supply are placed in an extrusion, running parallel to one another. The extrusion can be integrated into an engine cowling or into a cooling air guidance means. Supposedly, the advantage of this arrangement lies in a grouping of the fuel lines that is easily understandable, safe to operate, easy to install and space saving. Meanwhile, it is a disadvantage that all fuel lines connected to the engine have to be detached when the engine cowling is demounted for maintenance purposes. Detaching of the fuel lines and especially of the high-pressure connections of Common-Rail injection systems has to be avoided for the reasons explained above. Besides, it is impossible to use this arrangement in combination with individual cylinder heads. Finally, an extrusion is not suited for a high-pressure fuel reservoir. The strength factors of such an extrusion are by far not enough regarding the pressures that need to be controlled.

Proceeding from this state of the art, it is an object of this invention to develop a diesel engine with a Common-Rail injection system in such manner, that the high-pressure section of the injection system is securely cased and well positioned concerning vibration. In addition to that, it is of importance that the position and casing of the high pressure reservoir and the fuel injection lines not require structural modifications of the crankcase or of the cylinder head and that the mounted casing not have negative effects on maintenance or repairing of the diesel engine.

SUMMARY OF THE INVENTION

The supercharged diesel engine of the present application has a Common-Rail injection system, which utilizes at least one high pressure fuel reservoir that is connected with a high pressure fuel pump via a high pressure fuel line. The engine has at least one bank of cylinders having the cylinders thereof disposed in a row, wherein at least one cylinder head is associated with the bank of cylinders. At least one of the cylinders is associated with the cylinder head, which is provided with air inlet openings. A plurality of the cylinders are associated with the high pressure fuel reservoir, which is connected via fuel injection lines to respective fuel connections, disposed on the cylinder head, of individual ones of the cylinders. The engine furthermore has at least one charged air conduit for distribution of charged air and having a first chamber for conveying the charged air. The air inlet openings of the cylinder head are connected to the first chamber in a gastight manner, wherein the charged air conduit has at least one second chamber, which is separate from the first chamber and has a removable lid. Mounting means are provided in the second chamber, and the high pressure fuel reservoir is adapted to be secured in the second chamber via the mounting means. The second chamber is provided with a first passage via which the high pressure fuel line and the high pressure fuel reservoir are adapted to communicate with one another. The second chamber is also provided with at least one second passage, facing the cylinder head, via which the fuel injection lines and the fuel connections of the cylinder head are adapted to communicate with one another. When the lid is in place, the second chamber encloses the high pressure fuel reservoir, the fuel injection lines and the fuel connections such that in the event of leakage at any of these, leaking fuel is adapted to flow into the second chamber.

The invention is based on the following considerations. Placing the high-pressure fuel reservoir on or inside the crankcase or on or inside the cylinder head requires structural modifications of the crankcase and/or cylinder head. It is therefore not an option, especially if the crankcase and/or cylinder head are meant to be used in various different types of engines with different types of fuel injection systems. Structural modification of the crankcase and/or cylinder head is also not an option if engine concepts used throughout several engine generations are to be retrofitted without changing those components. Based on the considerations specified above, it was found that placing the high pressure fuel reservoir inside an additional chamber which is formed on to the charge air conduit induces several advantages. Primarily, any modifications of the crankcase or the cylinder head can be avoided, solely the charge air conduit, a relatively inexpensive attaching part, has to be modified. Furthermore, the charge air conduit is comparatively low in vibration, for it is structurally separated from the heavily vibrating parts of the diesel engine. In addition to that, it is possible to make the fuel injection lines very short and therefore avoid high vibrational amplitudes by placing the charge air conduit on the cold side of the diesel engine, next to the intake air openings of the cylinder head. On the diesel engine, the charge air conduit is one of the parts least affected by maintenance and repairing. Unnecessary detaching of high-pressure fuel reservoir and fuel injection lines can therefore be avoided. Provided that the cylinder head is continuous, it could be demounted without having to detach the high-pressure fuel reservoir or the fuel injection lines first. The charge air conduit, the high pressure fuel reservoir and the fuel injection lines form a structural unit that can be pre-assembled and can therefore reduce the expenditure during the final assembly of the diesel engine. By providing a removable lid, which seals the second chamber of the charge air conduit, the high-pressure fuel reservoir and the fuel injection lines are completely accessible, so that maintenance and repairing can take place unimpeded. A particular advantage is that the arrangement according to this invention can be used both on in-line engines and on V-enginges, each either with individual or continuous cylinder heads. In other words, it can be used on various types of engines, and retrofitting of mass produced engines is possible without modifications of the engine block.

By placing the high-pressure fuel reservoir into the second chamber of the charge air conduit, that chamber can be configured and sealed in such a way that certain parts of the high-pressure fuel reservoir are excluded from the casing. Excluded may be parts with low risk of breakage or parts that should be accessible even with the lid of the second chamber put on.

To avoid that possibly leaking fuel can accumulate in different places, the second chamber is configured in a simple and therefore advantageous way. For all applications occurring during normal operation of the diesel engine, possibly leaking fuel will accumulate in the geodetically lowest point of the second chamber.

Providing the second chamber with a discharge opening, which is most conveniently placed at the geodetically lowest point of that chamber, allows for leaked fuel to be drained off safely. This can be of particular importance if the diesel engine, for example on a ship, has to be kept running due to safety reasons, even though e.g. a fuel injection line has broken.

Providing the second chamber with a fuel sensor, which is most conveniently placed at the geodetically lowest point of that chamber, allows even for small amounts of leaked fuel to be detected reliably and makes it possible to raise an alarm in case of such an event.

The second chamber of the charge air conduit contains areas and openings through which, during all anticipated operating situations of the diesel engine, leaking or already leaked fuel could escape uncontrollably. Those areas and openings of the second chamber are sealed with regard to the surroundings to prevent leakage.

Figure 2:
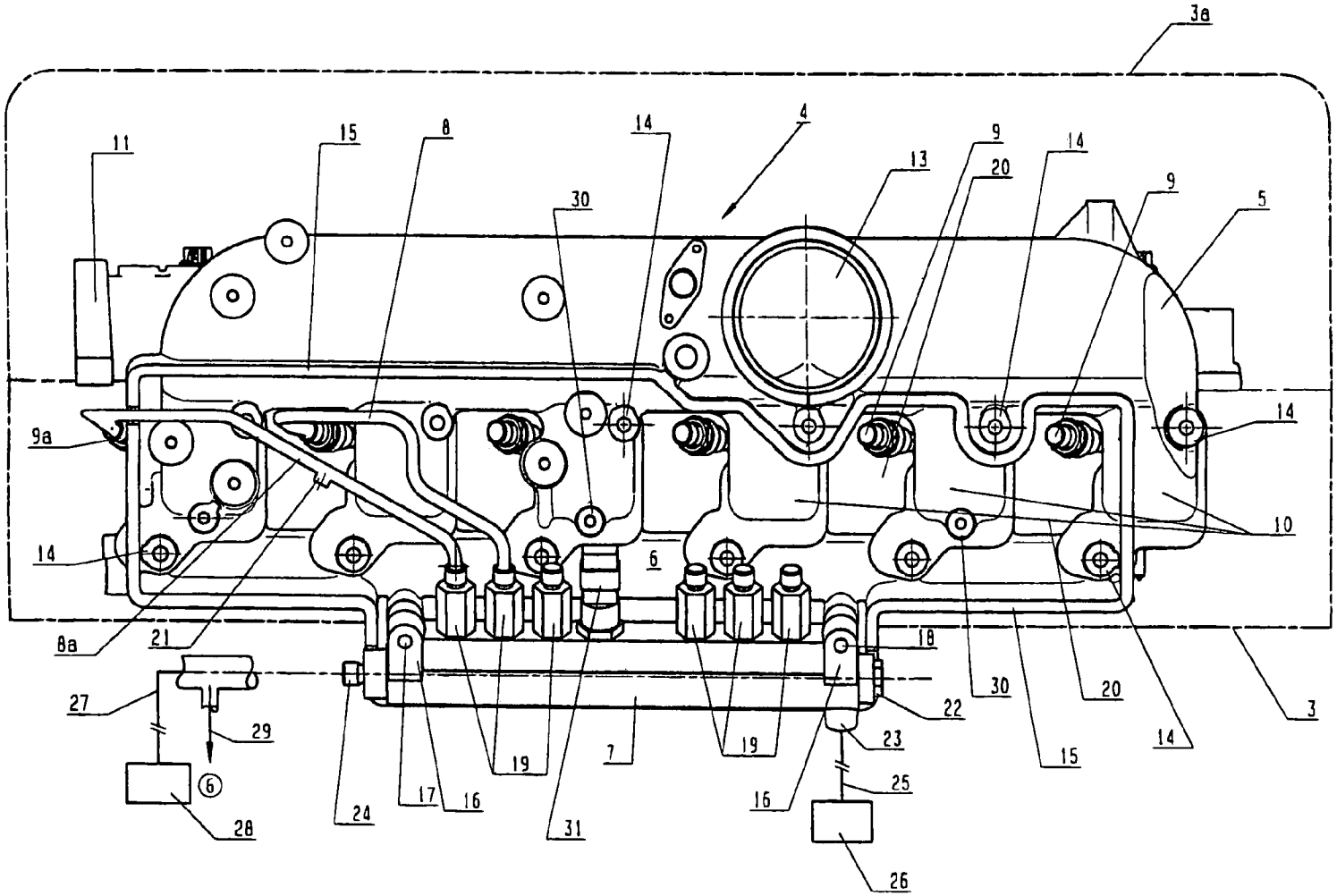
Figure 3:
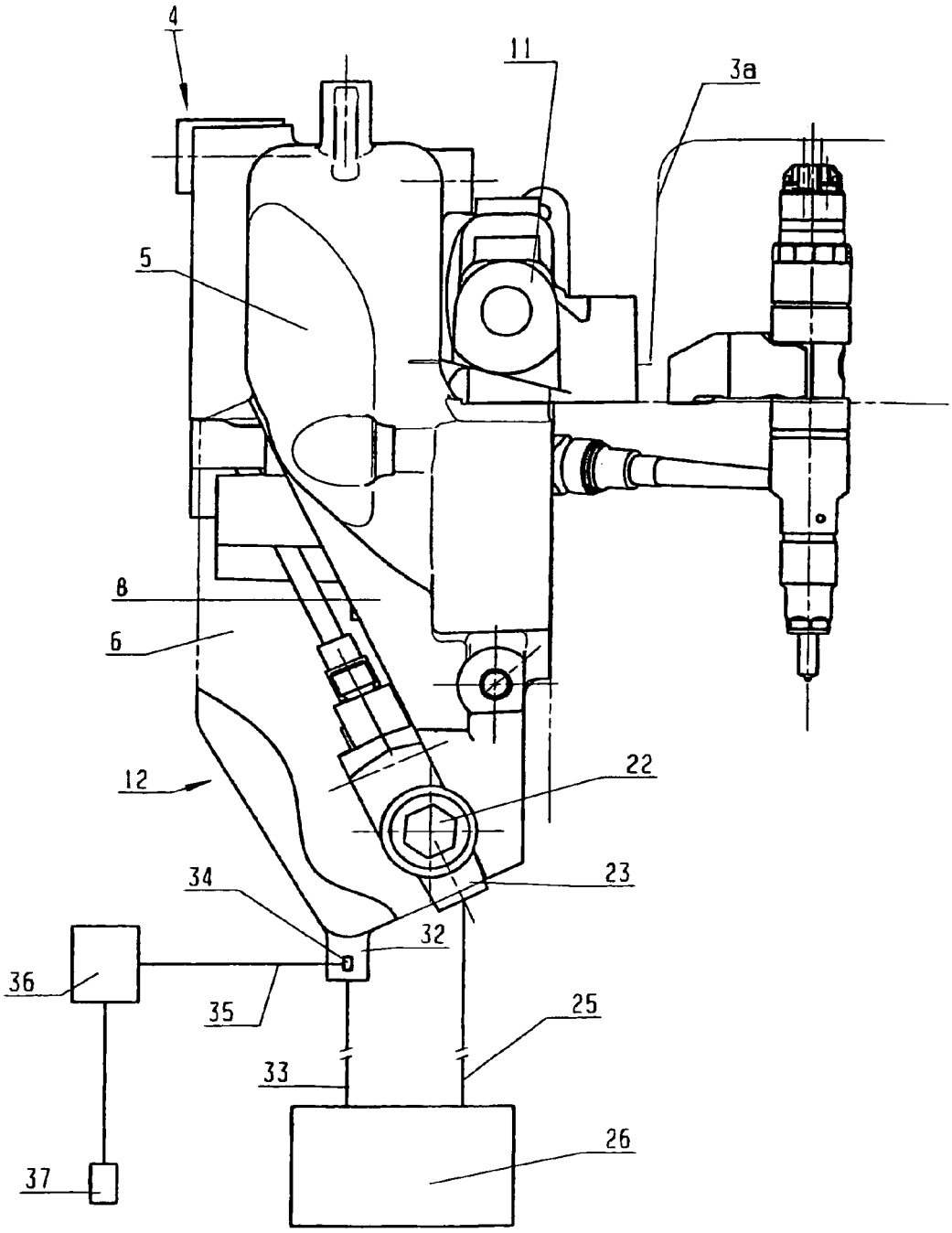

In addition to the advantages mentioned above, the following description explains further advantages and advantageous embodiments of the invention, in conjunction with the accompanying drawings, in which:

FIG. 1 shows a schematic representation of the main components in their spatial arrangement relative to one another;

FIG. 2 shows a representation of a charge air conduit, represented vertically to its longitudinal axis; and FIG. 3 shows a representation of the charge air conduit according to FIG. 2, represented parallel to its longitudinal axis For a better understanding of the arrangement according to this invention, FIG. 1 gives an overview of the spatial arrangement of the individual components. The diesel engine 1 represented in FIG. 1 with its crankcase 2 and, next to that, the cylinder head 3 is an in-line engine with a continuous cylinder head. The engine is shown parallel to its longitudinal axis. As mentioned above, the arrangement according to this invention is not restricted to that type of engine. It could also be used on a V-engine, and instead of the continuous cylinder head shown in the example, separate cylinder heads or cylinder heads containing more than one cylinder could be placed on the crankcase. According to FIG. 1, a charge air conduit 4 is placed on the cylinder head 3 and next to the cylinder head cap 3*a*. The charge air conduit 4 comprises a first chamber 5, which conveys the charge air, and a second chamber 6. A high-pressure fuel reservoir 7 with the connected fuel injection lines 8 is placed inside the chamber 6. The fuel injection lines 8 connect the high-pressure fuel reservoir 7 to the fuel connections 9 on the cylinder head 3. The chamber 5, which conveys the charge air, extends parallel to the longitudinal axis of the diesel engine and, via the transversely extending intake ducts intakes 10, is connected to corresponding intake openings (not represented in the drawing) in the cylinder head 3. A coolant conduit 11 runs parallel to the longitudinal axis of the charge air conduit 4 with parts of its walls directly next to the charge air conduit 4. The coolant conduit 11 is connected to coolant ducts (not represented in the drawing) in the cylinder head 3. In order to facilitate access to the second chamber 6 of the charge air conduit 4, that chamber has a lid 12, placed on the long side facing away from the cylinder head 3. The feed of charge air to the chamber 5 is realized through a charge air connection 13 shown in FIG.

2. The charge air connection 13 is connected to a supercharging device (not represented in the drawing) of the diesel engine 1.

FIG. 1 shows a schematic representation of the charge air conduit 4. In FIG. 2, the same charge air conduit 4 is shown more detailed in top plan view, at right angle to its longitudinal direction, with direction of view onto the side with the lid 12. In the representation shown in FIG. 2, the lid 12 is removed. The positions of the cylinder head 3 and, next to it, the cylinder head cap 3*a,* are indicated schematically by a dash-and-dot line.

The upper part of FIG. 2 shows the first chamber 5 of the charge air conduit 4 with its charge air connection 13. From the chamber 5, the intake ducts 10 curve downwardly and backwards and connect to the cylinder head 3, which, in FIG. 2, lies behind the charge air conduit 4. The charge air conduit 4 is mounted on the cylinder head 3, equivalent to conventional charge air conduits. Boltholes 14 are drilled into the wall of the charge air conduit 4 that is next to the cylinder head 3. The boltholes 14 correspond to tap holes (not represented) in the cylinder head 3. The bolts that mount the charge air conduit 4 on the cylinder head 3 are not shown in the drawing. For clarity reasons, only some of the bolt holes 14 and intake ducts 10 are provided with reference symbols.

Located below the first chamber 5 and easily distinguishable due to the circumferential sealing collar or gasket 15 is the second chamber 6 of the charge air conduit 4. The high-pressure fuel reservoir 7 is located in the lower part of the second chamber 6. The second chamber 6 is configured in a way that certain parts of the high-pressure fuel reservoir 7 jut out higher than the sealing collar 15. Those parts are accessible from the outside, even after the lid has been put on. The places where the high-pressure fuel reservoir protrudes through the wall of the second chamber 6 can be provided with sealing devices. The high-pressure fuel reservoir 7 is attached to the lower part of the second chamber 6 through mounting straps 16, which are formed on the high-pressure fuel reservoir 7. The mounting straps 16 are provided with boltholes 17 and are held by fixing bolts 18, which are screwed into tap holes (not represented in the drawing) in the charge air conduit 4.

To connect the high-pressure fuel reservoir 7 with the cylinder head 3, the high-pressure fuel reservoir 7 is provided with connecting couplings 19 that reach into the free space of the second chamber 6. The fuel injection lines 8, 8*a* connect the connecting couplings 19 on the high-pressure fuel reservoir 7 to the fuel connections 9 on the cylinder head 3. For clarity reasons, only two of the total six fuel injection lines are represented in FIG. 2. Openings 20 are located in the wall of the second chamber 6 that is facing the cylinder head 3. Through those openings 20, the fuel connections 9 on the cylinder head 3 are accessible. The openings 20 are sealed by those parts of the cylinder head 3 that lie behind them and, if required, by sealing means extending around the edges of the openings 20 (not represented).

For structural reasons, it is not always practicable that the second chamber 6 encloses all fuel connections 9. Such a case is represented in the left part of FIG. 2. The fuel connection 9*a,* located on the cylinder head 3, lies outside of the second chamber 6 of the charge air conduit 4. It is connected to the high-pressure fuel reservoir 7 by means of the double-walled fuel injection line 8*a* and through one of the connecting couplings 19. In the double-walled fuel injection line 8*a,* an inner, actual fuel injection line is separated from a surrounding outer line by an interspace. The interspace is connected to the second chamber 6 of the charge air conduit 4 through a connection 21, as FIG. 2 indicates in a simplified manner. Fuel that might leak into the interspace is conducted into the second chamber 6. Double-walled fuel injection lines and their connections are well known in motor vehicle technology. For this reason, the simplified representation in FIG. 2 does not have to be specified.

As mentioned above, the high-pressure fuel reservoir 7 is placed into the second chamber 6 of the charge air conduit 4 in such a way that certain parts of the high-pressure fuel reservoir 7 are situated outside of the chamber 6. The pertaining parts are the excess-pressure valve 22 and, connected to that, the discharge connector 23, both represented on the right side of FIG. 2, and the high pressure connection 24 of the high pressure fuel reservoir 7, shown on the left side of FIG. 2. The discharge connector 23 of the excess-pressure valve 22 is connected to the drain reservoir 26 through the connecting line 25. The drain reservoir 26 collects fuel returning from the fuel injection system. Through a high-pressure fuel line 27, the high-pressure connection 24 is connected to a high-pressure fuel pump 28. The high-pressure fuel pump 28 is responsible for generating the high fuel pressure. As FIG. 2 indicates in a simplified way, the high-pressure fuel line 27 is a double-walled line. The interspace between the actual high-pressure line and the surrounding outer line is connected to the second chamber 6 of the charge air conduit 4. In FIG. 2, that connection is indicated by the arrow labeled with number 29. A pressure sensor 31 can be installed on the high-pressure fuel reservoir 7 in order to determine the pressure conditions inside. The electrical connections (not represented) of the pressure sensor 31 can be run through the wall of the second chamber 6 in an appropriate place. Depending on its position, such a connection may require sealing.

The tap or threaded holes 30 in the second chamber 6 serve to attach the lid 12, which is not represented in FIG. 2. The tap holes 30 correspond to bolt holes (not represented) in the lid 12. By means of bolts (not represented), the lid 12 can be screwed onto the charge air conduit, sealing the second chamber 6 along its sealing collar 15. Between the lid 12 and the sealing collar 15, soft sealing material (not represented) may be applied.

In conjunction with FIG. 3, the following description explains the controlled drainage of fuel that flowed into the second chamber 6 of the charge air conduit 4 after leaking from the high-pressure section of the fuel injection system. FIG. 3 shows a side view, with direction of view from the right side, of the arrangement according to FIG. 2. The lid 12 is put on, and in the area of the lid, the arrangement is represented in a fractionized way.

FIG. 3 shows that a discharge connecotr 32 is located on the lid 12. The connector 32 is connected to the drain reservoir 26 through a return line 33. In case of fuel leaking from the high-pressure system of the fuel injection system, that fuel drains into the drain reservoir 26. In this example, the drain reservoir 26 mentioned above is the same reservoir that serves to collect fuel regularly draining out of the fuel injection system. Unlike the example presented here, there can be two separate drain reservoirs. The discharge connector 32 is placed in the geodetically lowest point of the second chamber 6. Therefore, no fuel can accumulate in the second chamber 6. For the sake of completeness it is mentioned that the inner relief of the second chamber 6 is naturally configured in a way that it descends steadily towards the discharge connector 32. It is assumed, that if the diesel engine is in a horizontal position, the charge air conduit 4 or at least its second chamber 6 is also horizontal. If the permissible and actual operating positions of the diesel engine differ significantly from the horizontal position, the inner walls of the second chamber 6 have to be configured in a way that they form a funnel, narrowing towards the discharge connector 32. Examples for such conditions are if the diesel engine is installed in a vessel or in a motor vehicle used in extreme terrain, such as a tracked vehicle, e.g., a snowmobile.

To detect fuel that is leaking from the high-pressure section of the fuel injection system, a fuel sensor 34 is placed in the discharge connector 32. Line 35 connects the fuel sensor 34 with an analyzing circuit 36, which can be part of an engine-controlling device. The analyzing circuit 36 acts on the alarm system 37, which raises an alarm if fuel is leaking from the high-pressure section of the fuel injection system. If permissible, an emergency turn off of the diesel engine can of course be performed by the analyzing circuit 36.

As mentioned above, double walled lines like the fuel injection line 8*a* and the high-pressure fuel line 27 have an interspace between the actual high-pressure line and the outer, surrounding line. Unlike the example described above, instead of being connected to the second chamber 6 of the charge air conduit 4, that interspace can be connected to the return line 33. In that case, the fuel sensor has to be placed downstream of that connection. Likewise, it is possible to provide the fuel injection line 8*a* and the high-pressure fuel line 27 or rather their interspaces or subsequently added lines with separate fuel sensors and to directly connect the interspaces with the drain reservoir 26.

Furthermore, the embodiment described in conjunction with the drawings can be varied in order to save material, weight and space. Parts of the walls of the second chamber 6 can therefore be formed by contiguous components. Eligible is e.g. that area of the second chamber 6 located right next to the coolant conduit 11. In that area, the wall of the chamber 6 can be omitted and replaced by the wall of the coolant conduit 11. Since the wall of the coolant conduit 11 seals the second chamber 6 towards the top, additional sealing is not required.

With the knowledge of one skilled in the art, the embodiments described above can naturally be configured in a great variety of ways without moving away from the basic idea of this invention. Therefore, the embodiments described above are to be seen only as examples.

The specification incorporates by reference the disclosure of German priority document 10 2004 058 350.1 filed Dec. 3, 2004.

The present invention is, of course, in no way restricted to the specific disclosure of the specification and drawings, but also encompasses any modifications within the scope of the appended claims.

The invention claimed is:

1. A supercharged diesel engine having a Common-Rail injection system which utilizes at least one high pressure fuel reservoir that is connected with a high pressure fuel pump via a high pressure fuel line, said supercharged diesel engine comprising:

at least one bank of cylinders having the cylinders thereof disposed in a row, wherein at least one cylinder head is associated with said bank of cylinders, wherein at least one of said cylinders is associated with said at least one cylinder head, which is provided with air inlet openings, and wherein a plurality of said cylinders are associated with said high pressure fuel reservoir, which is connected via fuel injection lines to respective fuel connections, disposed on said at least one cylinder head, of individual ones of said cylinders; and at least one charged air conduit for distribution of charged air and having a first chamber for conveying the charged air, wherein said air inlet openings of said at least one cylinder head are connected to said first chamber in a gastight manner, wherein said charged air conduit has at least one second chamber, which is separate from said first chamber and has a removable lid, wherein the mounting means are provided in said at least one second chamber, wherein said high pressure fuel reservoir is adapted to be secured in said at least one second chamber via said mounting means, wherein said at least one second chamber is provided with a first passage via which said high pressure fuel line and said high pressure fuel reservoir are adapted to communicate with one another, wherein said at least one second chamber is provided with at least one second passage, facing said at least one cylinder head, via which said fuel injection lines and said fuel connections of said at least one cylinder head are adapted to communicate with one another, and wherein said at least one second chamber, when said lid is in place, at least partially encloses said high pressure fuel reservoir, said fuel injection lines and said fuel connections such that in the event of leakage at any of said high pressure fuel reservoir, said fuel injection lines, and said fuel connections, leaking fuel is adapted to flow into said at least one second chamber, wherein said at least one charged air conduit is secured to said at least one cylinder head, and wherein said at least one second chamber is provided with an opening for a discharge of fuel that during leakage enters said second chamber, wherein said at least one second passage is sealed relative to a space surrounding said at least one charged air conduit, and wherein a sealing surface of said at least one second passage is formed by portions of said at least one cylinder head.

2. A diesel engine according to claim 1, wherein said first passage is formed by an opening in said at least one second chamber through which a portion of said high pressure fuel reservoir extends.

3. A diesel engine according to claim 1, wherein said at least one second chamber is embodied such that in all positions of use of said engine that occur during normal operation, it has an equally geodetically lowest location.

4. A diesel engine according to claim 1, wherein said opening for the discharge of fuel entering during leakage is disposed at said geodetically lowest location.

5. A diesel engine according to claim 1, wherein a fuel sensor is disposed in said at least one second chamber by means of which the presence of free fuel in said second chamber is adapted to be detected.

6. A diesel engine according to claim 5, wherein said fuel sensor is disposed at said geodetically lowest location.

7. A diesel engine according to claim 6, wherein said fuel sensor is disposed in said opening for the discharge of fuel entering during leakage.

8. A diesel engine according to claim 1, wherein said first passage is sealed relative to a space surrounding said at least one charged air conduit.

9. A diesel engine according to claim 1, wherein said at least one second chamber of said at least one charged air conduit has at least one wall that is formed by a component that is disposed on said at least one cylinder head and is adjacent to said at least one charged air conduit.

10. A diesel engine according to claim 9, wherein said component is a coolant conduit that is adapted to convey coolant used for cooling said engine.

11. A diesel engine according to claim 1, wherein at least one third passage is provided in said at least one second chamber, and wherein an excess-pressure valve of said high pressure fuel reservoir is accessible from the outside via said third passage.

12. A diesel engine according to claim 11, wherein said at least one third passage is sealed relative to a space surrounding said at least one charged air conduit.

13. A diesel engine according to claim 1, wherein at least one cable passage is provided in said at least one second chamber, and wherein at least one sensor, which is disposed in said second chamber, is adapted to be connected with a control mechanism disposed externally of said second chamber via said cable passage.

14. A diesel engine according to claim 13, wherein said at least one cable passage is sealed relative to a space surrounding said at least one charged air conduit.

15. A diesel engine according to claim 5, wherein said fuel sensor (34) is connected to an analyzing device.

16. A diesel engine according to claim 15, wherein said analyzing device is connected to an alarm.

* * * * *